United States Patent [19]

Menown et al.

[11] 4,123,684

[45] Oct. 31, 1978

[54] THYRATRONS

[75] Inventors: Hugh Menown, Writtle; Robert J. Wheldon, Chelmsford, both of England

[73] Assignee: English Electric Valve Company Limited, Chelmsford, England

[21] Appl. No.: 778,255

[22] Filed: Mar. 16, 1977

[30] Foreign Application Priority Data

Mar. 18, 1976 [GB] United Kingdom ..... 10889/76

[51] Int. Cl.[2] ..... H01J 17/04

[52] U.S. Cl. ..... 313/205; 313/38; 313/207

[58] Field of Search ..... 313/205, 207, 37, 38

[56] References Cited

U.S. PATENT DOCUMENTS 3,005,924 10/1961 Reilly et al. ..... 313/205 X

*Primary Examiner*—Rudolph V. Rolinec
*Assistant Examiner*—Darwin R. Hostetter
*Attorney, Agent, or Firm*—Diller, Brown, Ramik & Wight

[57] ABSTRACT

A thyratron is provided with a baffled structure between its cathode and first control electrode. The baffled structure consists of a series (e.g. three) annular baffle plates, each having a central aperture aligned with the axis of the cathode, mounted on the end of a cylindrical heat shield surrounding the cathode. The final annular baffle plate, adjacent the first control electrode includes a solid disc within its central aperture.

13 Claims, 2 Drawing Figures

THYRATRONS

This invention relates to thyratrons and in particular to thyratrons including gas fillings of hydrogen or its isotope deuterium.

Traditionally the cathode structure of a hydrogen thyratron consists of a filament coated with suitable electron emitting material or, and more usually, an indirectly heated metal cylinder coated with electron emitting material. Very often the filament or cylinder forming the cathode is surrounded by a heat shield which has the effect of reducing heat losses by radiation from the cathode.

In operation, the cathode of the known thyratron has to emit sufficient electrons to initiate and maintain the discharge within the thyratron and to withstand any subsequent ion bombardment during the period of conduction.

It is believed that, where there is a heat shield, this assists the cathode both by contributing to the emission of electrons and by diverting a proportion of the positive ions away from the coating of the cathode.

The present invention seeks to provide an improved thyratron in which the beneficial effects associated with the provision of a heat shield are featured and enhanced.

According to this invention, a thyratron includes a thermionic cathode and a baffled structure arranged between said thermionic cathode and the first control electrode of the thyratron.

Said cathode may be a directly heated filament, but, preferably said cathode comprises an indirectly heated cylinder.

Preferably said cathode is surrounded by a cylindrical heat shield in which case preferably said baffled structure is mounted on the end of said heat shield towards said first control electrode.

Preferably said baffled structure comprises a series of annular baffle plates within a cylindrical housing, each annular baffle plate having a central aperture and the central apertures in said annular plates being aligned and co-axial with the axis of the cathode.

Typically, said baffled structure comprises three annular baffle plates.

In one example of thyratron in accordance with the present invention, wherein said baffled structure comprises a plurality of annular baffle plates each having a central aperture the final annular baffle plate, adjacent said first control electrode, includes a solid disc within its central aperture, said solid disc and said final annular baffle plate being substantially co-planar.

Said solid disc in some cases may be arranged to operate at a potential which is common to that of the baffled structure. In other cases means are provided for applying bias potential to said solid disc independent of said cathode and said baffled structure.

Figure 1:
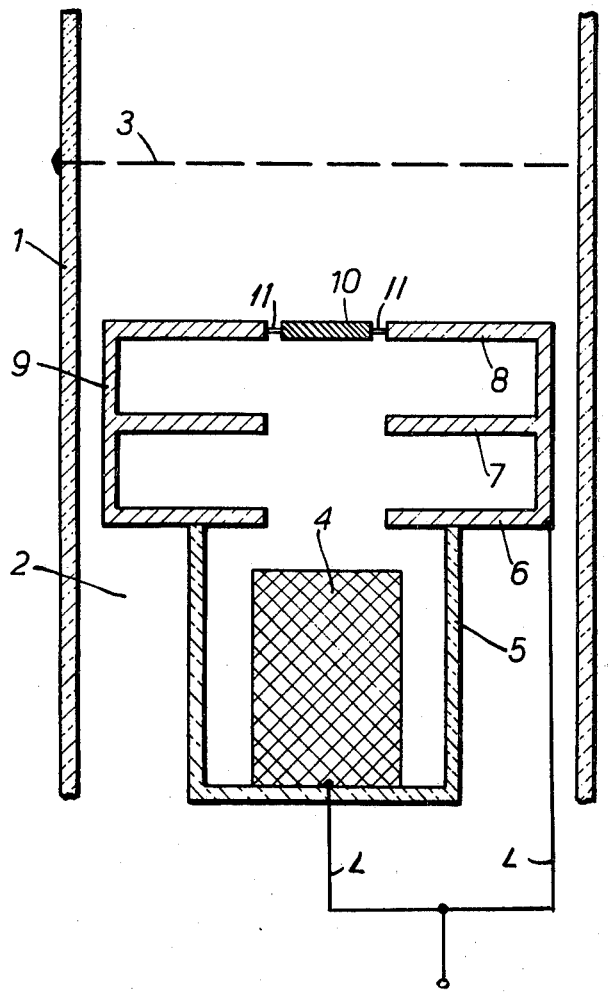
Figure 2:
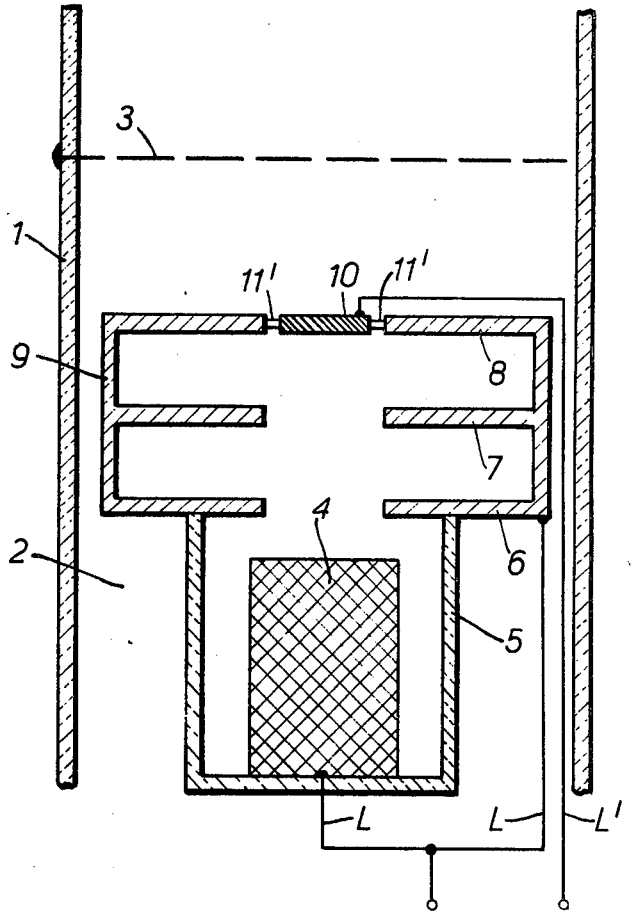

The invention is illustrated in and further described with reference to the accompanying drawing wherein:

FIG. 1 is a longitudinal section taken through a portion of a thyratron according to this invention; and FIG. 2 is a view similar to FIG. 1 but showing a modified construction.

Within a glass envelope 1 having a gaseous filling of hydrogen or its isotope deuterium is shown a cathode structure 2 and a first control electrode 3 which latter is normally referred to as "G1" and is the control electrode to which bias is normally applied in order to preionise the thyratron and create plasma in the region of the cathode.

The present invention concerns the cathode structure and the remaining grids of the tube may be wholly conventional and are accordingly not represented.

The cathode structure 2 consists of an indirectly heated cathode 4, in the form of a cylinder coated with electron emitting material. Surrounding the cathode 4 is a co-axial cylindrical heat shield 5, as known per se, which is provided to reduce heat losses by radiation from the cathode 4, to contribute partly to the emission of electrons and to tend to protect the cathode from positive ion bombardment by diverting a substantial proportion of such positive ions away from the actual cathode coating of the cathode 4.

Arranged between the cathode 4 and the first grid 3 is a baffled structure consisting of a series, in this case three in number, of annular baffle plates 6, 7 and 8. The baffle plates 6, 7 and 8 are arranged within a cylindrical housing member 9 and attached to, and carried by, the heat shield 5.

The diameters of the central apertures presented by each of the annular baffle plates 6, 7 and 8 are similar and sufficiently great as not seriously to impede the initial emission of electrons from the cathode 4. Within the aperture in baffle plate 8 is mounted a solid disc 10 which is approximately co-planar with the plate 8 and of diameter less than the diameter of the aperture in plate 8.

The plates 6, 7 and 8, the cylindrical housing 9, and the solid disc 10 are of conductive material of such nature as not to seriously affect the operational life of the thyratron. In this particular example, the material is nickel.

In FIGS. 1 and 2, the baffle plates 6, 7 and 8 and the cylindrical housing 9 are operated at the potential of cathode 4 as indicated by the connecting leads L'. In FIG. 1, the solid disc 10 is also provided to operate at cathode potential the electrically conductive support arms 11 being provided for this purpose, whereas in FIG. 2 the support arms 11' are insulators and, the solid disc 10 is provided with a separate lead L' so as to be operated at an independent potential whereby bias may be applied thereto in order to ionise the gas in its vicinity prior to conduction.

The distance separating the plates 6, 7 and 8 from one another is less than 1 cm. and greater than 1 mm. These distances may be found capable of optimisation for optimum performance.

In operation, following triggering, by means of a control grid (not shown) following the first grid 3, the cathode 4 itself must initially supply all the electrons necessary to provide the total anode current. As plasma forms within and around the baffle structure, provided by plates 6, 7 and 8 and cylindrical housing 9, this is believed to result in electrons and positive ions oscillating within the spaces in the baffle structure thereby causing extra electrons to be emitted by a hollow cathode process.

Thus, the structure provides extra electrons for the discharge so easing the load on the cathode 4. At the same time the whole re-entrant shape of the baffle structure makes it virtually impossible for high energy positive ions to strike the actual electron emitting surface of the cathode 4 and so tending to increase the operational life of the cathode 4.

We claim:

1. A thyratron including a thermionic cathode, at least a first control electrode, and a baffled structure arranged between said thermionic cathode and said first control electrode, said baffled structure comprising a plurality of baffled plates forming at least two transversely extending cavities connected to be at cathode potential.

2. A thyratron as claimed in claim 1 and wherein said cathode is a directly heated filament.

3. A thyratron as claimed in claim 1 and wherein said cathode comprises an indirectly heated cylinder.

4. A thyratron as claimed in claim 1 and wherein said cathode is surrounded by a cylindrical heat shield.

5. A thyratron as claimed in claim 4 and wherein said baffled structure is mounted on the end of said heat shield towards said first control electrode.

6. A thyratron as claimed in claim 1 and wherein said baffled structure comprises a series of annular baffle plates within a cylindrical housing, each annular baffle plate having a central aperture and the central apertures in said annular plates being aligned and co-axial with the axis of the cathode.

7. A thyratron as claimed in claim 1 wherein said baffled structure comprises a plurality of annular baffle plates each having a central aperture and wherein the final annular baffle plate, adjacent said first control electrode, includes a solid disc within its central aperture, said solid disc and said final annular baffle plate being substantially co-planar.

8. A thyratron as claimed in claim 7 and wherein said solid disc is arranged to operate at a potential which is common to that of the baffled structure.

9. A thyratron as claimed in claim 7 and wherein means are provided for applying bias potential to said solid disc independent of said cathode and said baffled structure.

10. A thyratron as claimed in claim 1 and wherein said baffled structure comprises three annular baffle plates.

11. In a thyratron assembly, the combination of:

an evacuated envelope having a thermionic cathode disposed therewithin;

a heat shield surrounding said cathode and presenting a recess defining an opening through which electrons emitted from said cathode may pass;

a control electrode within said envelope and positioned in spaced relation from said heat shield beyond said opening defined thereby; and means defining at least two transversely extending cavities between said opening defined by the heat shield and said control electrode for enhancing the beneficial effects of said heat shield, said means comprising at least three baffle plates disposed in spaced, generally parallel relation to define said cavities therebetween, each plate having an opening aligned with said opening defined by the heat shield, and said baffle plates being electrically connected to each other and to said cathode so as to be electrically isolated from said control electrode while operating at the potential of said cathode.

12. In a thyratron assembly as defined in claim 11 including a solid disc disposed within and partially filling the opening in that baffle plate nearest said control electrode, said disc being electrically connected to said baffle plates.

13. In a thyratron assembly as defined in claim 11 including a solid disc disposed within and partially filling the opening in that baffle plate nearest said control electrode, said disc being electrically isolated from said baffle plates and including means for connecting the disc to potential different from that potential applied to said cathode and said baffle plates.

* * * * *